US005662076A

United States Patent [19]

Ohtsubo et al.

[11] Patent Number: 5,662,076

[45] Date of Patent: Sep. 2, 1997

[54] TAPPET IN AN INTERNAL COMBUSTION ENGINE

[75] Inventors: Kizuku Ohtsubo, Kawasaki; Satoshi Fukuoka, Atsugi; Tatsuo Kanzaki, Yamato, all of Japan

[73] Assignee: Fuji Oozx Inc., Japan

[21] Appl. No.: 634,729

[22] Filed: Apr. 19, 1996

[51] Int. Cl.[6] ..... F01L 1/16

[52] U.S. Cl. ..... 123/90.51; 123/90.48

[58] Field of Search ..... 123/90.48, 90.51; 74/569

[56] References Cited

U.S. PATENT DOCUMENTS

| | | | |
|---|---|---|---|
| 3,683,876 | 8/1972 | Lesher | 123/90.51 |
| 4,317,433 | 3/1982 | Fuhrmann | 123/90.51 |
| 4,538,562 | 9/1985 | Matsui et al. | 123/90.51 |
| 5,060,607 | 10/1991 | Taniguchi | 123/90.51 |
| 5,284,112 | 2/1994 | Takehara et al. | 123/90.51 |

FOREIGN PATENT DOCUMENTS 40 28 985 A1 3/1992 Germany .

OTHER PUBLICATIONS

European Search Report dated Sep. 30, 1996.

Patent Abstracts of Japan Publication No. JP3011107 of Jan. 18, 1991.

Patent Abstracts of Japan Publication No. JP3149305 of Jun. 25, 1991.

Patent Abstracts of Japan Publication No. JP7332028 of Dec. 12, 1995.

*Primary Examiner*—Weilun Lo

*Attorney, Agent, or Firm*—Oppenheimer Poms Smith

[57] ABSTRACT

A tappet is used in an internal combustion engine. A cam receiving plate which contacts a cam is brazed on the upper surface of a top wall of a tappet body. The whole surface of the cam receiving plate can act as a cam follower surface, thereby making the outer diameter of the cam receiving plate to the minimum size corresponding to projected length of a nose of a rotary cam and lightening the tappet.

3 Claims, 3 Drawing Sheets

TAPPET IN AN INTERNAL COMBUSTION ENGINE

BACKGROUND OF THE INVENTION

The present invention relates to a tappet in which a body is made of light metal such as Al alloy, and in particular, to a tappet in an internal combustion engine, comprising wear resistant material at contact surface with a rotary cam.

To lighten a direct acting type valve operating mechanism in an internal combustion engine, Al alloy tappets are widely used instead of conventional steel tappets. Al alloy tappets are lower than steel alloy tappets in strength and wear resistance, and thus, wear resistant material is applied on the upper surface of a tappet which is slidably engaged with a rotary cam.

FIG. 5 illustrates a conventional Al tappet in which a cylindrical body 21 closed by an upper wall 21*a* at the upper end is molded from Al alloy. On the upper surface of the upper wall 21*a*, there is placed a wear resistant cam receiving plate 22 which has a smaller outer diameter than the body 21. The cam receiving plate 22 is fixed on the upper surface of the upper wall 22*a* by bending an annular protrusion 21*b* inwardly at the outer circumference of the upper end of the body 21. 23 denotes a rotary cam which contacts the upper surface of the cam receiving plate 22.

The cam receiving plate 22 of the Al alloy tappet acts as a cam follower to a nose 23*a* of the rotary cam 23. To rotate the rotary cam 23 smoothly, the size or area of the cam receiving plate 22 must be equal or larger than a rotation trace of the nose 23*a*. The maximum lift length is determined depending on the projected length of the nose 23*a* from a base circle. Efficiency of intake and exhaust air is determined on the lift length. Thus, to obtain a desired intake and exhaust efficiency, it is necessary to determine the size of the projection of the nose 23*a* suitably and to keep the diameter of the cam receiving plate 22 in size which is corresponding to the projection of the nose 23*a*.

As the conventional tappets, since the cam receiving plate 22 is fixed by caulking of the annular protrusion 22*b* to decrease an effective surface area of the cam receiving plate 22, it is necessary to attach the cam receiving plate 22 having a relatively large diameter in the body 21 having a relatively large diameter to provide a surface area corresponding to the nose 23*a* of the cam 23. However, the tappet body increases in weight, the cylinder head increases in size, and flexibility in design of the engine decreases.

SUMMARY OF THE INVENTION

In view of the disadvantages, it is an object of the present invention to provide a tappet in an internal combustion engine wherein the tappet is fixed to a cam receiving plate having minimum size, thereby decreasing weight of a tappet body.

According to one aspect of the present invention, there is provided a tappet in an internal combustion engine, the tappet comprising a cylindrical body made of light metal and having a top wall, and a wear resistant cam receiving plate which has roughly equal diameter to an outer diameter of the body, the cam receiving plate being brazed on the upper surface of the body.

The whole surface of the cam receiving plate can act as a cam follower surface. Thus, the outer diameter of the cam receiving plate may be a minimum length corresponding to a projected length of a rotary cam. The outer diameter of the body is made smaller, thereby providing smaller size thereof.

According to another aspect of the present invention, there is provided a tappet in an internal combustion engine, the tappet comprising a cylindrical body made of light metal, and a wear resistant cam receiving plate having roughly equal diameter to an outer diameter of the body, an annular projection being formed adjacent to the circumference of a lower surface of the cam receiving plate, the annular projection being forcibly inserted in the inner circumferential surface of the body, the cam receiving plate being brazed on the body.

There is no upper wall, thereby saving an amount of use and making smaller size.

BRIEF DESCRIPTION OF THE DRAWINGS

The features and advantages of the present invention will become more apparent from the following description with respect to embodiments as shown in appended drawings wherein.

DETAILED DESCRIPTION OF PREFERRED EMBODIMENTS

Figure 1:
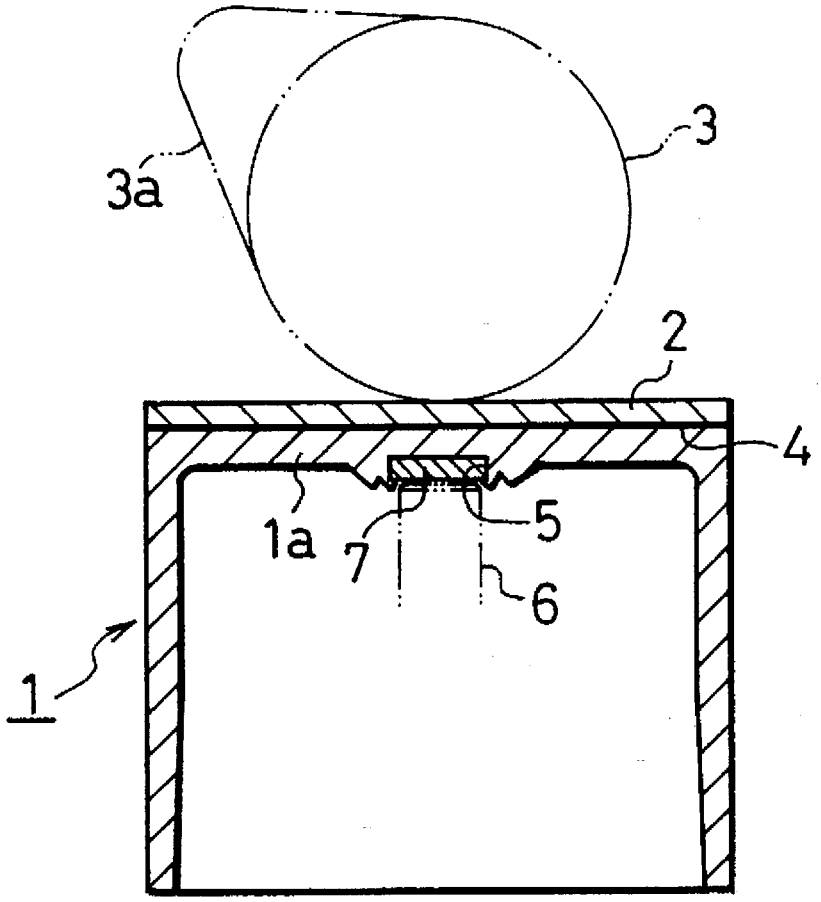
FIG. 1 is a central vertical sectional front view of the first embodiment of the present invention.

The first embodiment of the present invention is illustrated in FIG. 1, wherein a body 1 is made of Al alloy to which T8 treatment according to Japanese Industrial Standards (JIS) is applied, Fe thermal spraying being applied to the outer circumferential surface to increase wear resistance. On a top wall 1*a* of the body 1, a cam receiving plate 2 having the same diameter with an outer diameter of the body 1 is brazed by brazing filler material 4, which may be preferably Sn-Zn alloy having melting point of 200° to 380° C., such as SAL-APX, SAL-CRZ and SAL-APY according to JIS. Maximum use temperature of the tappet is usually about 150° C., and to obtain required joining strength under use temperature condition, melting point needs more than 200° C. Furthermore, when the body 1 is heated in soldering, strength decreases as it comes to heat treatment temperature such as 500° C. At 380° C., strength is suddenly decreased. Accordingly, it is necessary not to heat the body to over 380° C. by the brazing filler material 4 having melting point less than 380° C.

To braze the cam receiving plate 2, the powdery or sheet-like brazing filler material is put on the top wall 1*a*, and the cam receiving plate 2 is disposed thereon. Then, the body 1 and the cam receiving plate 2 are heated at roughly equal temperature to melting point of the brazing filler material 4 in a suitable heat source such as a vacuum furnace, so that the brazing filler material 4 is melted, thereby joining the top wall 1*a* integrally with the cam receiving plate 2. Surface treatment such as Cu metal plating on the joining surface of the cam receiving plate 2 increases joining property of the brazing filler material 4 to provide stable qualities.

In a groove 5 in the middle of the lower surface of the top wall 1*a*, a tip 7 made of wear resistant metal and engaged with the end of the engine valve 6 is engaged. In this embodiment, the cam receiving plate 2 is joined on the top wall 1*a* by brazing without conventional caulking, so that the whole surface of the cam receiving plate 2 can act as cam follower surface. Therefore, the outer diameter of the cam receiving plate 2 may be minimum size corresponding to the projection length of the nose 3*a*, so that the outer diameter of the body 1 becomes smaller to provide smaller size of the whole. The brazing filler material having melting point of 200° to 380° C. provides sufficient joining strength and is not liable to decrease strength of the whole body 1.

Figure 2:
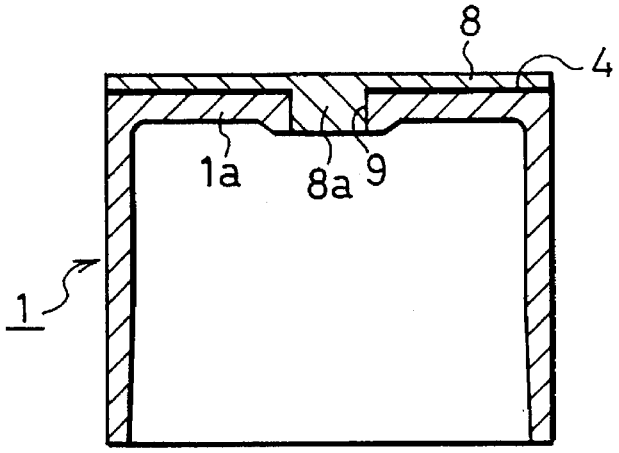
FIG. 2 is a central vertical sectional front view of the second embodiment of the present invention.

The second embodiment of the present invention is shown in FIG. 2, in which a downward cylindrical projection 8*a* engaged with the end of a valve is integrally formed with a cam receiving plate 8, engaged in a bore 9 in the middle of the top wall 1*a*, and joined with the cam receiving plate 8 and the top wall 1*a* with a brazing filler material 4 as above.

In the second embodiment, similar advantages to the first embodiment are achieved. Furthermore, centering of the body 1 and the cam receiving plate 8 can be easily carried out exactly, thereby preventing temperature fall of a heat source and joining surface without centering jigs in joining which causes temperature fall. The tip 7 in the first embodiment is not required, thereby reducing the number of parts and facilitating manufacturing steps.

Figure 3:
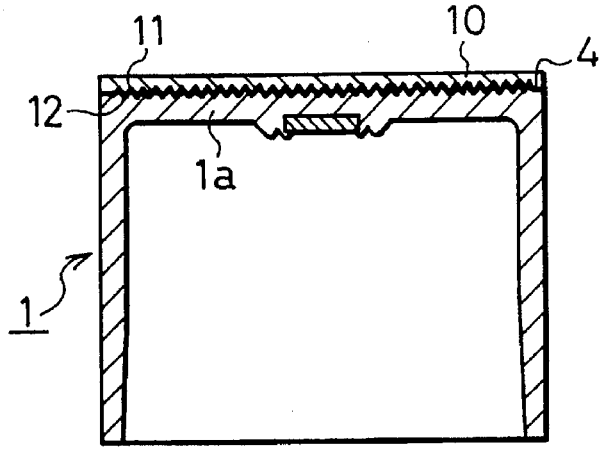
FIG. 3 is a central vertical sectional front view of the third embodiment of the present invention.

The third embodiment of the present invention is shown in FIG. 3, in which concentric annular grooves 11 and projections 12 which are suitably engaged with each other are formed on the top wall 1*a* and the cam receiving plate 10 respectively, thereby joining the cam receiving plate 10 to the top wall 1*a* with the brazing filler material 4. In the third embodiment, similar advantages to the first and second embodiments are achieved, and engagement of the annular grooves 11 and projections 12 prevents release of joining surfaces owing to difference in thermal expansion between the body 1 and the cam receiving plate 10.

Figure 4:
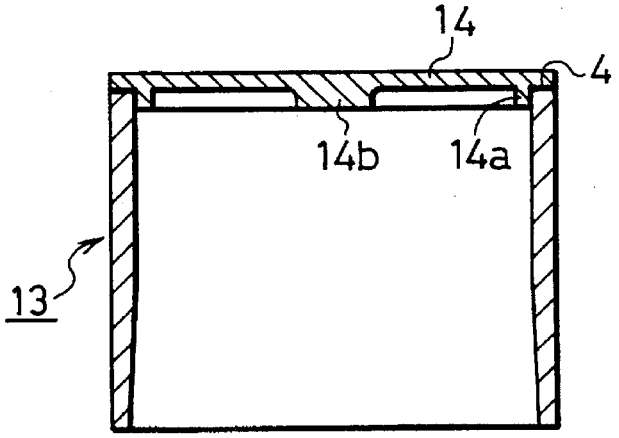
FIG. 4 is a central vertical sectional front view of the fourth embodiment of the present invention.
Figure 5:
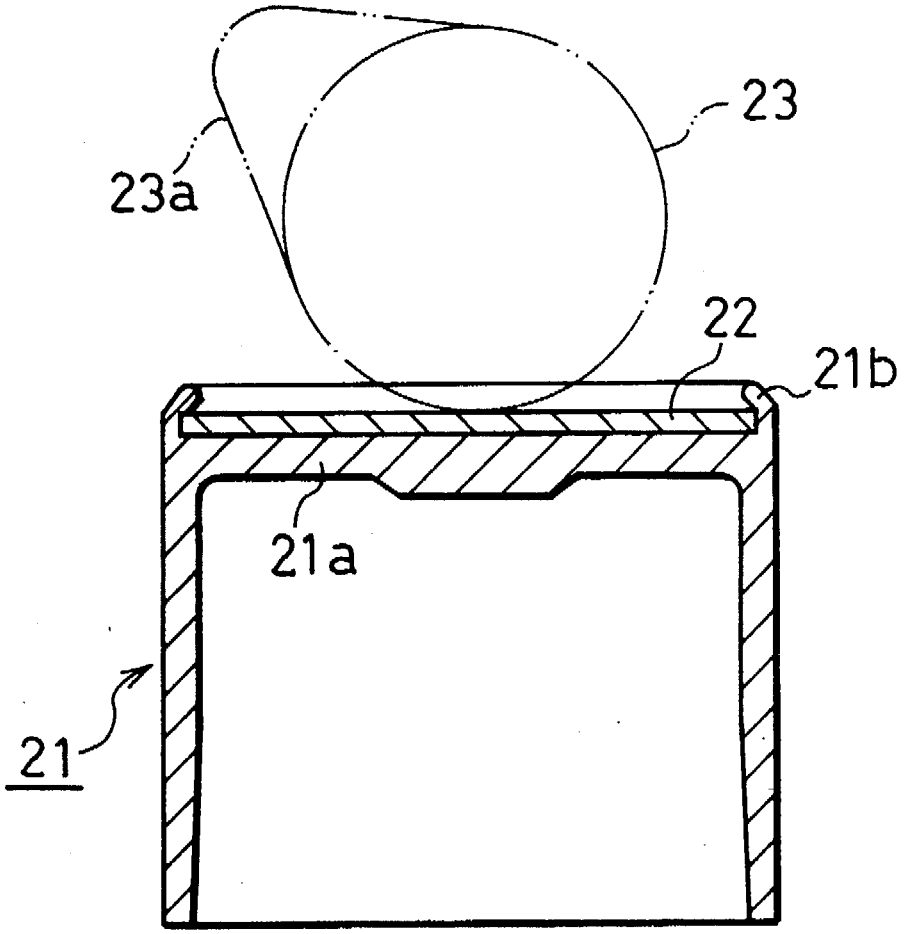
FIG. 5 PRIOR ART
FIG. 5 is a central vertical sectional front view of a conventional tappet.

The fourth embodiment of the present invention is shown in FIG. 4, in which on the upper end of a cylindrical body 13, a cam receiving plate 14 has diameter equal to an outer diameter of a body 13, and a downward annular portion 14*a* having outer diameter roughly equal to inner diameter of the body 13. The annular portion 14*a* is engaged in the inner surface of the body 13 and contact surfaces are joined with a brazing filler material 4.

A projection 14*b* which contacts the end of a valve is formed in the middle of the lower surface of the cam receiving plate 14. In the fourth embodiment, similar advantages to the above embodiments can be achieved. Al alloy material is saved and the tappet can be made lighter since there is no top wall of the body 13.

The present invention may be applied to a tappet which has a body made of Mg alloy.

The foregoings merely relate to embodiments of the present invention. Various modifications and changes may be made by person skilled in the art without departing from the scope of claims wherein:

What is claimed is:

1. A tappet in an internal combustion engine, the tappet comprising:

a cylindrical body made of light metal and having a top wall; and a wear resistant cam receiving plate which has roughly equal diameter to an outer diameter of the body, the cam receiving plate being brazed on an upper surface of the body, wherein concentric projections and grooves are formed on contact surfaces of the top wall and the cam receiving plate, the projections being engaged with the grooves.

2. A tappet as defined in claim 1 wherein a brazing filler material has melting point of 200° to 380° C.

3. A tappet as defined in claim 1 wherein the light metal comprises Al alloy.

* * * * *